United States Patent [19]

Maschler et al.

[11] 4,312,716

[45] Jan. 26, 1982

[54] SUPPORTING AN ARRAY OF ELONGATE ARTICLES

[75] Inventors: Francis S. Maschler, Kansas City; Gary A. Seifert, Lee's Summit, both of Mo.

[73] Assignee: Western Electric Co., Inc., New York, N.Y.

[21] Appl. No.: 209,079

[22] Filed: Nov. 21, 1980

[51] Int. Cl.[3] ..... C25D 5/02; C25D 17/06

[52] U.S. Cl. ..... 204/15; 204/224 R; 204/297 W

[58] Field of Search ..... 204/15, 224 R, 297 W

[56] References Cited

U.S. PATENT DOCUMENTS

| | | | |
|---|---|---|---|
| 2,073,679 | 3/1937 | Brown | 204/297 W |
| 2,137,819 | 11/1938 | Wagner | 204/297 W |
| 2,588,589 | 3/1952 | Tauber . | |
| 3,553,096 | 1/1971 | Coir | 204/297 W |
| 3,610,613 | 10/1971 | Worden . | |
| 3,682,083 | 8/1972 | Riente . | |
| 4,015,940 | 4/1977 | Conlon . | |
| 4,125,216 | 11/1978 | Ozimec . | |
| 4,152,241 | 5/1979 | Warren | 204/297 W |

FOREIGN PATENT DOCUMENTS

| | | | |
|---|---|---|---|
| 517869 | 2/1931 | Fed. Rep. of Germany | 204/297 W |
| 664704 | 1/1952 | United Kingdom | 204/297 R |
| 1204956 | 9/1970 | United Kingdom | 204/224 R |

*Primary Examiner*—T. M. Tufariello

*Attorney, Agent, or Firm*—W. O. Schellin

[57] ABSTRACT

End portions of a plurality of articles (12) are simultaneously treated in an electrolytic bath. End portions of the articles are inserted into an array of apertures (17) extending between major surfaces of a planar holder (11). Inserting the articles (12) into the apertures guides them into an interfering contact with coil springs (28). Coils of the springs (28) are urged aside and provide an urging force to retain the articles in the holder (11). The contact of the springs (28) with the articles (12) also establishes electrical continuity between the articles (12) through the springs (28) to external ends (43) of anchoring rods (37) for the springs, such that when the ends (43) are coupled into a treating circuit and protruding ends of the articles depend into a treating bath such ends become treated. A frame located relative to the surface of the treating bath receives the holder (11) and establishes a reference for the depth of insertion of the articles into the bath.

4 Claims, 12 Drawing Figures

FIG.-2
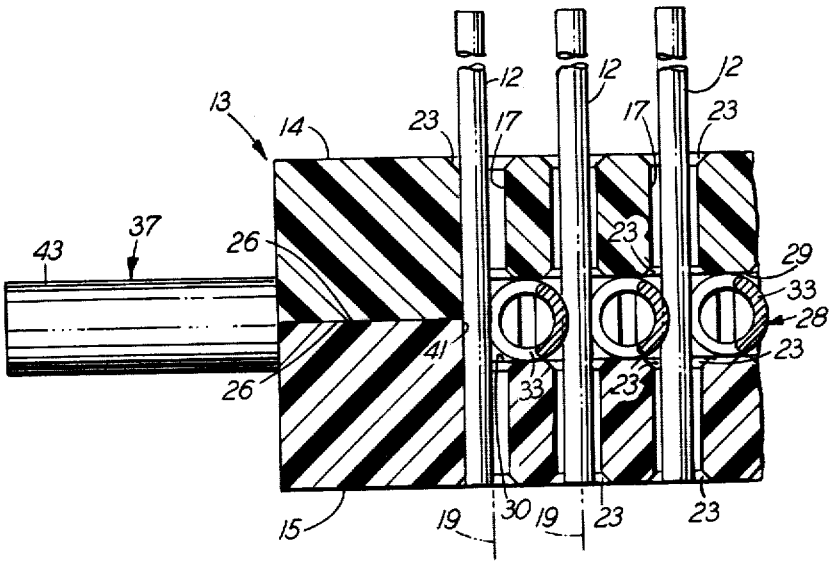
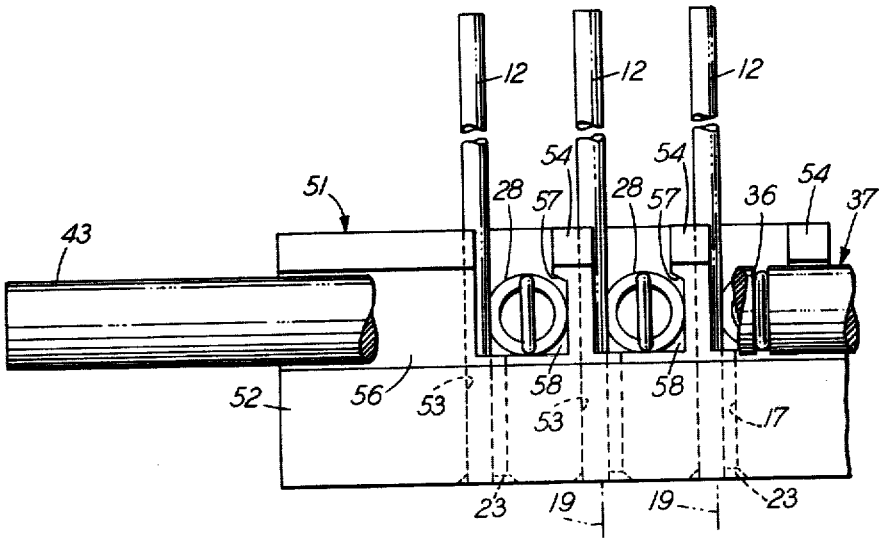
FIG.-3

SUPPORTING AN ARRAY OF ELONGATE ARTICLES

TECHNICAL FIELD

This invention relates to supporting an array of articles. More particularly, the invention relates to arranging a plurality of electrically conductive articles in an array such that the articles extend in parallel to each other and each article is coupled to an electrode. In the array, the position of each of the articles is longitudinally adjustable to permit one end of each of the articles to be exposed to an electrolytic plating solution. Thus, one specific use of the invention lies in the field of plating at least one end of each of a plurality of elongate articles.

BACKGROUND OF THE INVENTION

In the manufacture of mercury-wetted, sealed contact switches, an end portion of an elongate article referred to as a stem is plated with nickel to promote the wettability of such end by mercury after the stem is assembled into a glass envelope of the switch. However, at the same time, care must be taken to retain the center portion of the article free of such nickel plate. Such center portion is to be sealed into the glass wall of a switch, and the nickel plate is known to exhibit poor adhesion to glass. To treat or plate one end of such an article may be expensive unless simple mass handling procedures can be employed.

To plate a predetermined length of one end of the articles in an economically feasible manner in accordance with the prior art, the articles are typically loaded, according to one particular method, into a plating rack wherein they abut against a magnetic holding plate which then retains the abutting ends of the articles. The holding plate serves simultaneously as a reference plane for the longitudinal positioning of the articles and provides electrical contact to the articles, to couple each of such articles into the plating circuit.

One disadvantage of such a prior art holder is that the contact resistances between the articles and the holding plate of the rack are not uniform. The result is a variation in the plating thickness from one article to another. A most serious situation occurs, however, when some of the articles, even though they are apparently held against the holding plate, receive a completely insufficient plating deposit or no plating deposit at all. It appears that a thin corrosion film or corrosion particle, which is likely to be found near electrolytic treating facilities, may become interposed between some of the articles and the holding plate to effectively insulate the particular article from the plating circuit.

Another disadvantage of the prior art plating rack relates to the holding power of the magnetic field. When the free ends of the articles extend downward from the rack into the plating bath, some of the articles are released at times from the rack, whereupon the articles either drop into the plating bath, from where they have to be removed, or they attach themselves to adjacent articles as they fall through the induced magnetic field of such articles. Of course, these attached articles disturb the electric fields in the plating bath thereby causing irregular current densities which, in turn, affect the plating deposits on neighboring ones of the articles, as well as on those which become linked by the magnetic attachment.

It appears desirable to have a more efficient facility for supporting articles above a plating bath. It is further desirable to include in such a facility a simple and reliable contact to each of the articles, such that the electric field generated about each of the articles in the plating bath is for all practical purposes equal to the field located about all the other articles.

SUMMARY OF THE INVENTION

In accordance with this invention, a holder includes a planar guide having guide surfaces extending perpendicularly to a major plane of the guide for receiving a plurality of elongate articles. In a preferred embodiment the guide surfaces are formed to locate such articles in an orderly array. The articles are held in position with respect to the guide surfaces by coils of a plurality of springs which are located parallel to each other and to the major plane of the guide.

An electrically conductive rod is mounted at each of two opposite ends of the holder. The rods are positioned between and parallel to an upper and a lower planar surface of the guide and extend laterally from the guide as lateral supports of the holder. The springs are electrically conductive tension springs which are mounted between the rods in a space between such upper and lower surfaces of the guide and are restrained from vertical movement by portions of the guide. The holder can be supported above an electrolytic treating bath by the laterally extending rods with either the upper or the lower surface of the guide facing up. Thus, either end of the plurality of the elongate articles may be supported depending toward such treating bath.

BRIEF DESCRIPTION OF THE DRAWING

Various features and advantages will be best understood from the following detailed description when read in reference to the accompanying drawing, wherein:

FIG. 2 shows a portion of the holder of FIG. 1 in cross section and with articles inserted in apertures and held therein by coils of springs;

FIG. 3 depicts a portion of another embodiment of the holder of FIG. 1 in cross section;

DETAILED DESCRIPTION

Figure 1:
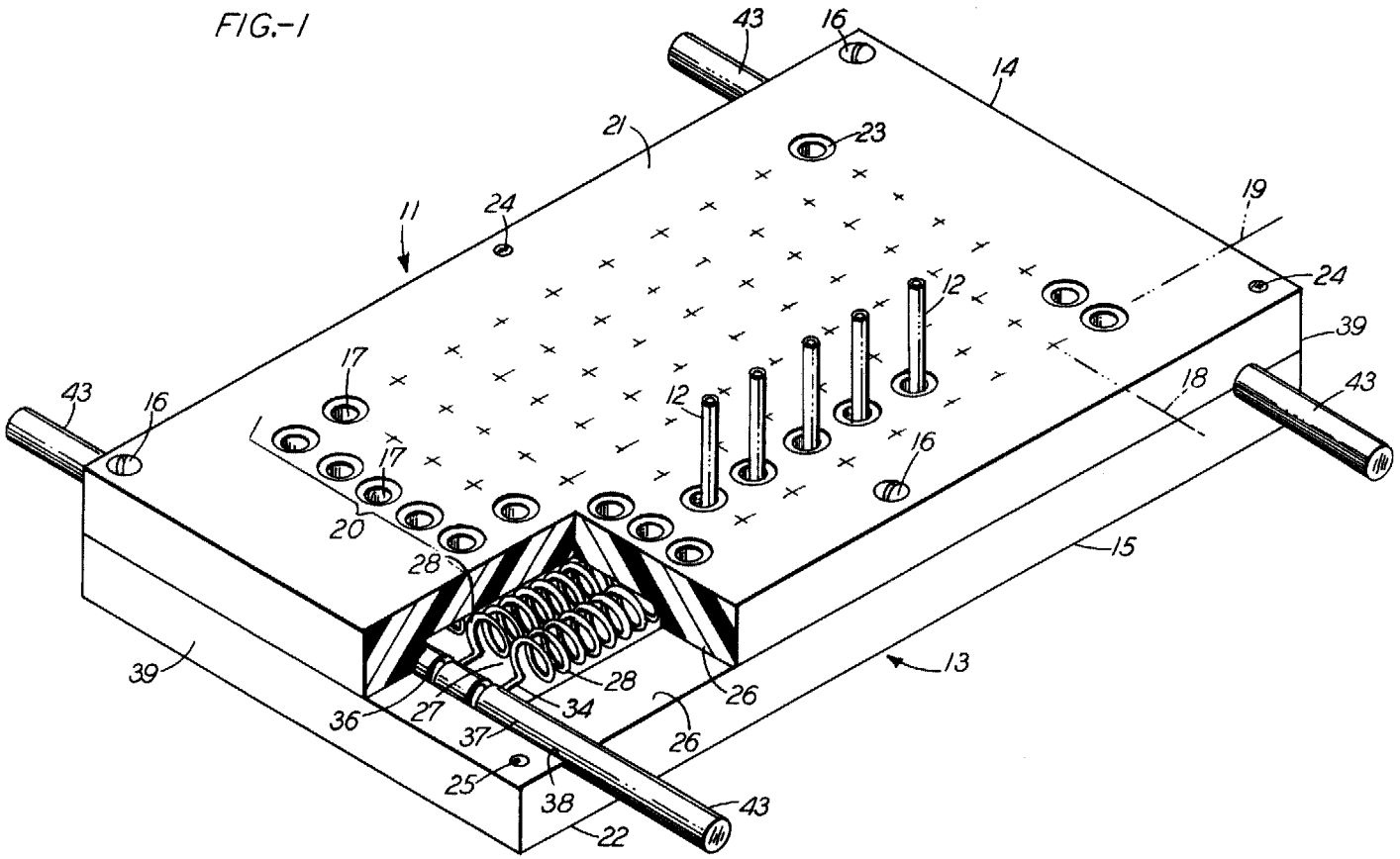
FIG. 1 is a partially sectioned, pictorial representation of a holder incorporating features of the present invention.

In reference to FIG. 1, there is shown a holder, which is designated generally by the numeral 11. The holder 11 is capable of supporting an array of elongate articles 12 in accordance with the present invention. A housing or outer structure 13 of the holder 11 consists of an upper plate 14 and a lower plate 15. The plates 14 and 15 are fastened into the single structure 13 by screws 16, or the plates may be fastened to each other by other removable fasteners, such as clamps or the like, as may be found convenient.

The major function of the structure 13 is to guide the articles 12. The shape of the articles 12 with respect to which the present invention is described is cylindrical. The articles are typically all of the same length. As stems intended for assembly into mercury switches, the articles are also tubular or hollow. However, this latter characteristic is of no functional significance to the holder. Also, the length and the cross-sectional shape of the articles 12 are only of significance to the extent that those characteristics could affect the shape and length of guide surfaces in the plates 14 and 15.

To guide the articles 12 and hold them in an array, apertures 17 are preferably of circular cross section and are formed in each of the plates 14 and 15 in preferably equally spaced rows 18 and columns 19 of an orderly array 20. The apertures 17 in the upper plate 14 are also located in a vertically coincident relationship with the corresponding apertures 17 in the lower plate 15 when the two plates are assembled into the single structure 13. Furthermore, when the two plates 14 and 15 are assembled into the single structure 13, a major outer surface 21 of the upper plate 14 is parallel to a major outer surface 22 of the lower plate 15. For the apertures 17 in each of the plates to cooperate and serve most ideally as guide surfaces for the articles 12, the apertures 17 are circular in cross section and larger in diameter by a small margin to permit the articles 12 to be slidingly received therein.

In general, selecting a diameter size for the apertures 17 is a matter of choice as long as a size is selected which is reasonably larger than the diameter of the cross section of the articles. A small amount of clearance between the outer surface of the articles 12 and the adjacent wall of the apertures 17 provides precise guiding for the articles. The articles guided by such apertures are nearly parallel to each other and substantially perpendicular to the plates. Of course, such small clearances between the articles 12 and the apertures 17 also make it more difficult to initially insert the articles 12 into the apertures 17. An increase in diameter of the apertures 17 over the diameter of the cross section of the articles permitting about a 2.5 degree of deviation of the orientation of the inserted articles 17 from the vertical was still found to be acceptable when the articles 12 were held in the apertures in accordance with further features of this invention. Of course, the maximum permissible amount of angular deviation of the articles from the vertical depends also on the length of the articles 12 and on the spacing of the articles in the array. In the described embodiment the articles 12 are about 25 mm long and have a diameter of about 1 mm. The spacing between adjacent ones of the apertures 17 is about 3 mm. Countersinks 23 may be formed leading into the apertures 17 of the plates 14 and 15 to further help to guide the articles toward the apertures during their insertion.

FIG. 1 shows the plates 14 and 15 as being identical. Such an identical configuration of the plates may be preferred to minimize tooling costs for making the plates. Since the array of apertures 17 in one of the plates is already identical to that in the other plate, and details, such as locations for threaded apertures 24 and corresponding body holes 25 for fastening the plates to each other, can be located in symmetry therewith, joining two identical plates as the upper plate 14 and the lower plate 15 presents no difficulty. The identity of the two plates 14 and 15, of course, results in the countersinks 23 about the apertures 17 being formed at both major surfaces of each of the plates, as it is best shown in FIG. 2.

Referring to FIGS. 1 and 2, outer walls 26 at opposite sides of the plates 14 and 15 separate the plates from each other to form a cavity 27 therebetween. In accordance with this invention, a plurality of parallel springs 28 span the length of the cavity 27. The inwardly directed major surfaces 29 and 30 of the plates 14 and 15 restrict the vertical movement of the springs 28 within the cavity 27. The springs are further located within the cavity 27 on axes centered between adjacent ones of the columns 19 of the apertures 17. The diameter of the springs 28 is chosen to extend into interfering relationship with the apertures 17. Thus, when an article 12 is inserted into one of the apertures 17, the inserted article 12 displaces interfering coils 33 of the springs 28.

It has been found that the urging force exerted by the displaced coils 33 to return to their normal positions within the outlines of the vertical projections of the apertures 17 acts in conjunction with a suitably opposed counterforce, as will be explained herein below as a gripping force on the inserted article 12. In one embodiment shown in FIG. 1, the articles 12 are predominantly secured between the coils 33 of adjacently located springs 28. To center the springs 28 precisely between the adjacent columns 19 of the apertures 17, the springs 28 are preferably tension springs which, when stretched, conveniently tend to extend in straight lines between known anchoring points. Ends 34 of the springs 28 are anchored in a corresponding number of spaced grooves 36 of two rods 37 each one of which is located in one of two recesses 38 oriented transversely to the extent of the springs 28 at opposite ends 39 of the holder 11.

Referring now to FIG. 2, there is shown a cross section through a portion of the holder 11 shown in FIG. 1, the section showing also a number of the articles 12 which have been inserted in the apertures 17. In the holder 11, the articles 12 in all columns 19 of apertures 17, except the two outermost column of apertures in the array 20, are held between two adjacent ones of the springs 28. In FIG. 2, the article 12 shown in the aperture 17 of the outermost column 19 adjacent the outer walls 26, however, is preferably urged by the outermost spring 28 against inner guide surfaces 41 of the walls 26 in the upper and lower plates 14 and 15. In the preferred embodiment such guide surfaces 41 are coextensive with wall portions of the apertures 17.

Holding the articles 12 between a guide surface 41 and a single spring 28 becomes an alternate embodiment of holding the articles 12. Holding the articles 12 by pressing them against the surfaces 41 increases the precision by which the articles 12 are guided in comparison with holding the articles 12 between two opposite springs 28. It needs to be pointed out that it is not necessary to support the outermost column of articles at each side of the holder against the outer walls 26 of the plates 14 and 15 but to support the articles in the outermost column between two adjacent springs 28 as well. However, when the articles 12 in the outermost column 19 on either side of the holder are supported by the coils 33 of one spring 28 urging the articles 12 against the guide surfaces 41, a convenient savings in the lateral size of the holder 11 and the savings of two of the springs 28 have been achieved. Thus in the holder 11 shown in FIGS. 1 and 2, two viable methods of holding the articles 12 are depicted.

In addition to providing an effective holding force to retain the inserted articles 12 in the apertures 17 of the holder 11, the springs 28 have been found to be capable of establishing a reliable electrical contact to the articles 12. To minimize contact resistance, the springs 28 are preferably gold plated. The contractile force exerted by the springs 28 which is supported by the rods 37 establishes a reliable electrical contact between the rods 37 and the springs 28. Preferably the rods 37 are also gold plated. The base material of both the rods 37 and the springs 28 is preferably stainless steel.

As it can be seen in FIG. 1, the rods 37 extend outwardly from the holder on both sides of the holder. Exposed ends 43 of the rods 37 also serve a double purpose, in that the ends 43 are used to support the holder 11 above a plating bath 44 (see FIG. 9), and, at the same time, establish external contact to a typical plating circuit 46. The circuit 46 includes such typical components as a power supply 47, a conductor 48 leading to the bath 44, an anode 49 and, of course, the bath 44 itself is considered part of the circuit 46.

FIG. 3 shows a section of a portion of a holder 51 which is an alternate embodiment of the holder 11 shown in FIGS. 1 and 2. Primarily, the holder 51 differs from the holder 11 in that only a single structural component or body 52 replaces the upper and lower plates 14 and 15, and in that the articles 12 in each column 19 of the holder 51 are urged from one side by spring force against a guide surface 53. A slight disadvantage of the holder 51 over the preferred holder 11 may be recognized in that the spacing of the columns 19 of apertures 17 in the holder 51 is increased slightly over the spacing of the columns 19 in the holder 11 and that, consequently, the density of the array of articles 12 is not as great in the holder 51.

Figure 4:
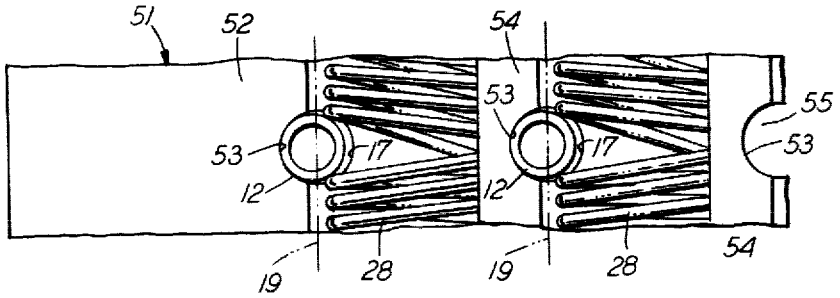
FIG. 4 shows a top view of the sectioned portion of the holder in FIG. 3.

FIG. 4 shows a top view of a portion of the holder 51. The effectiveness of the guide surfaces 53 in the holder 51 is optimized by forming them as a channel-like continuation of the aperture 17 in interposed walls 54 between the springs 28. The guide surfaces 53 therefore cause the walls to be thinner at the locations where the articles 12 are held, whereby the spacings between adjacent columns 19 become compressed by the depth of the channels 55 of the guide surfaces 53 within the walls 54. The rods 37 are preferably mounted in a transverse end groove 56, as shown in FIG. 3. Once the springs 28 are assembled to the rods 37, the spring force urges the rods 37 into the end grooves 56 to secure the assembled springs 28 and rods 37. A downwardly facing ledge 57 in an undercut 58 on each of the walls 54 restricts vertical displacement of the springs 28 during a vertical pull on the articles 12, for example.

It should be realized, however, that further changes can be made to the holders 11 or 51 without departing from the scope of the invention. It is, for example, possible to interconnect the walls 54 to form an upper plate similar to the upper plate 14 having a similar major surface 21. However, such a surface 21 of the holder 51 would be part of the unitary body 52. The springs 28 would accordingly be routed in such an embodiment through covered tunnels which extend the length of the holder 51 to interconnect the transverse end grooves 56.

Figure 5:
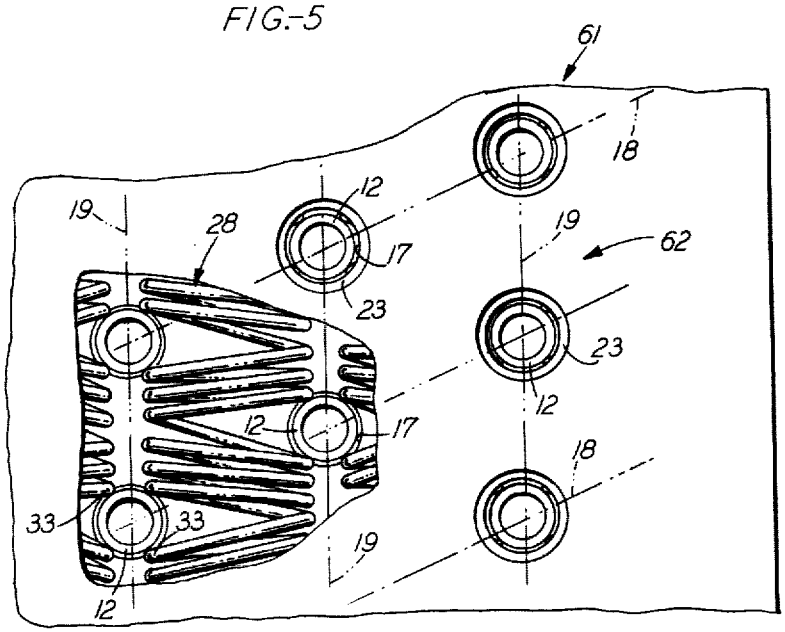
FIG. 5 is a top view of a portion of a holder showing yet another embodiment of the present invention.

FIG. 5 shows a further embodiment of a holder which is designated generally by the numberal 61. The holder 61 is similar to the holders 11 and 51 and could be formed either with a double plate structure like the holder 11, or with a unitary body like the holder 51. A significant distinction of the holder 61 is an offset in the aperture spacing in adjacent ones of the columns 19. This offset results in an array 62 of the apertures 17 in which the rows 18 are no longer orthogonal to the columns 19 as those of the holders 11 and 51 shown in FIGS. 1 and 4. An advantage in such an array 62 is that a displacement of one of the springs 28 in a direction perpendicular to the longitudinal axis of an inserted article 12 and perpendicular to the longitudinal axis of such spring 28 is not directly opposed by the displacement of one of the adjacent springs 28 caused by an insertion of another article 12 in the same row 18 and in an adjacent column 19. Instead, a lateral displacement of any of the springs 28, as would result from an insertion of one of the articles 12 into a respective one of the apertures, will occupy a portion of the space between two adjacent apertures 17 in an adjoining column 19 of apertures. As a result, the insertion of one of the articles 12 has only a small influence on the spring action exerted against another, adjacent article 12. As is seen from the partial top view of the holder 61 in FIG. 5, the array density established by the spacing of the apertures 17 in a major surface 63 is substantially identical to the array density of the apertures 17 of the holder 11 shown in FIG. 1.

Figure 6:
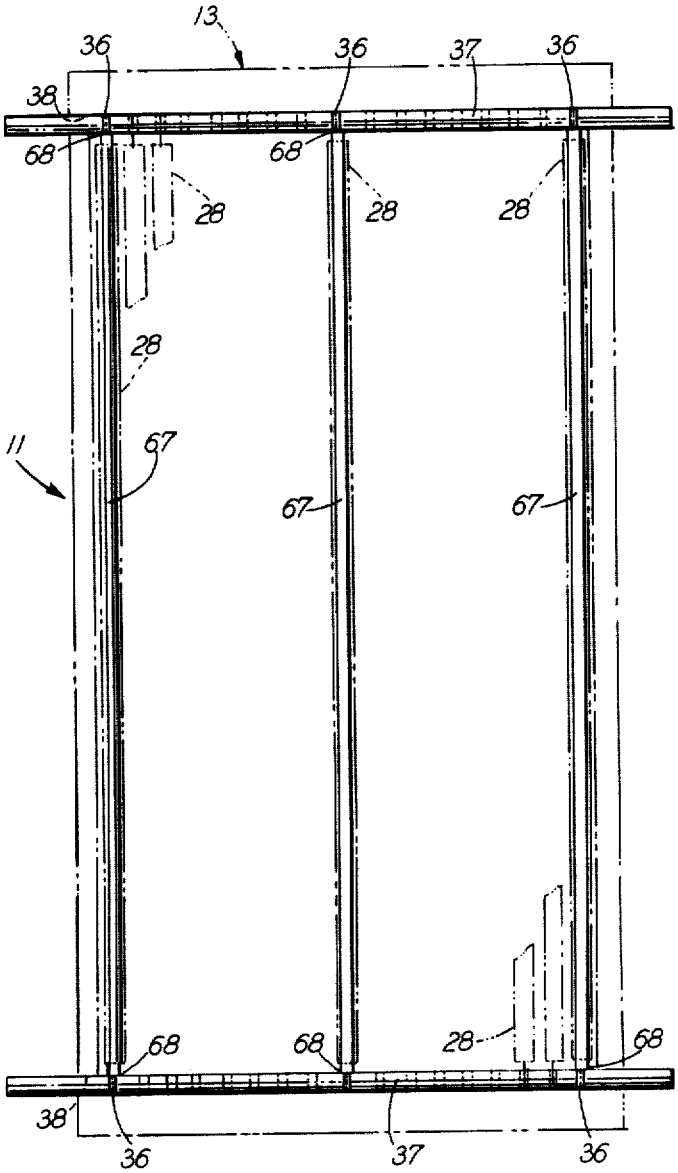
FIG. 6 shows a support frame for mounting a plurality of springs used for holding and contacting articles as one embodiment of this invention.

It was found that plastic materials such as polyethylene or polyvinyl chloride, for example, which may be used, and are presently preferred for forming the plates 14 and 15 for the holder 11 or the holder 61 or unitary bodies 52 for the holder 51 in a molding process, have a tendency to warp after the holder is fully assembled. Such warping occurs when the constant and relatively large forces exerted by the springs 28 in the assembled holders act directly on the plastic materials of the molded structures. Referring now to FIG. 6, there is shown a spring support frame, which is designated generally by the numeral 66. The frame 66 substantially solves the problem of structural warping of the holders. Longitudinal stainless steel rods 67 are routed through at least some of the springs 28 to space the transverse rods 37 by a predetermined distance to correspond to the nominal spacing of, for example, the recesses 38 at opposite ends of the holder 11. The rods 67 are typically smaller in diameter than the end rods 37 and are preferably anchored against seats at the base of blind holes 68 which are formed radially inward into the rods 37 and centered on the peripheral grooves 36 for mounting the respective springs 28. The support of the rods 37 by the longitudinal rods 67 relieves the plastic components of the respective holder of warping stresses.

Routing the rods 67 axially through the insides of the springs 28 (only three of which are shown in FIG. 6) offers a space saving advantage in that none of the rods 67 are interposed between adjacent outside surfaces of adjacent springs 28. Consequently, there is no need for a break in the pattern of the springs 28 and in the density of the array of apertures in the holder, such as the holder 11 shown in phantom lines in FIG. 6.

It may further be desirable to reduce the contractile force exerted by each of the springs 28 to minimize the total compressive force acting on the rods 67 of the frame 66. One method to achieve such a reduction in force is to wind the springs with initially open turns, such that a gap exists between adjacent coils 33 when the springs 28 are in their unstretched state. For example, a spring 28 formed of a music wire of 0.25 mm diameter may have 27 turns per centimeter instead of 40, thereby giving the appearance of a stretched condition through its partially open turns without having a contractile force applied to the spring 28. Such an initial stretch reduces the ultimate force required to stretch such spring 28 to about twice its closed coil length at which the spacing between adjacent coils of wire approximately equals the diameter of the spring wire. By closed coil length is meant the minimum length which the spring 28 can occupy when its coils of wire are contiguous.

It should be noted, however, that the outer structure 13 of the holders, either the plates 14 and 15 or the unitary body 52 may be formed of a metal such as, for example, stainless steel. When the plates 14 and 15, for example, are formed of steel rather than plastic, the plates themselves are sufficiently strong to resist warping and the need for the support frame 66, and particularly the longitudinal rods 67, is obviated.

Figure 7:
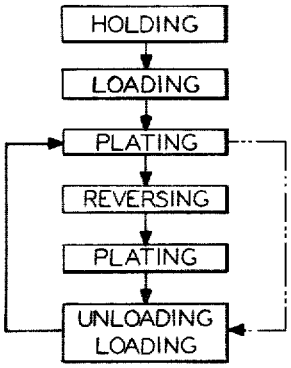
FIG. 7 is a schematic flow diagram outlining preferred methods of handling and plating a plurality of articles in accordance with this invention.

FIG. 7 is a schematic diagram of a preferred process in which the described holders 11, 51 or 61 are advantageously used to handle the articles 12 in conjunction with a plating operation in accordance with the present invention. Of course, not withstanding the following detailed description of a preferred process, it should be apparent that various changes to the process of handling the articles 12 can be made without departing from the spirit and scope of this invention.

Figure 8:
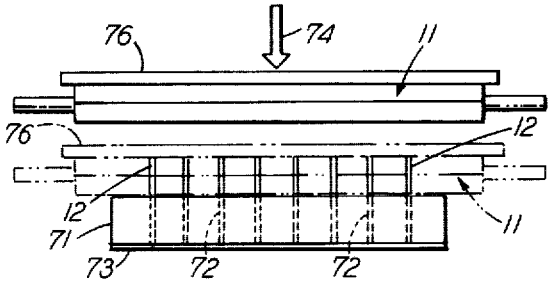
FIG. 8 depicts inserting an array of articles into a holder, such as the one shown in FIG. 1.

The step of holding, as highlighted in FIG. 7, is best explained in further reference to FIG. 8. Arrayed articles 12 are first movably supported in the vertical direction, yet in the horizontal directions are nevertheless precisely positioned in what is referred to as a loading fixture 71. The loading fixture 71 is in essence a tray which has vertical guide tracks 72 for slidably supporting an array of the articles 12. The array in the loading fixture 71 corresponds precisely to the array of apertures 17 in, for example, the holder 11. A base plate 73 which is part of the loading fixture 71 retains the articles 12 in the fixture.

Again in reference to FIG. 8, the articles 12 are loaded into the holder in preparation for the plating operation by transferring the articles 12 from the loading fixture 71 to, for example, the holder 11. It should be realized, that when the holder 11 is referred to at any point in the following description, a similar reference to the other holders 51 and 61 is implicit. However, inasmuch as the arrays of apertures of each of the holders may differ from those of the other holders in each of the transfer steps, apparatus used in conjunction with such transfer steps, such as the loading fixture 71, must have an array of guides 72 or apertures to correspond with the array in the holder which is used in that particular operation.

To transfer the articles 12 from the loading fixture 71 to the holder 11, the holder 11 is placed over the articles 12 such that the arrays in the holder 11 and in the loading fixture 71 are aligned. The countersinks 23 (see FIG. 1) help in the transfer of the articles 12 when such an alignment is slightly less than perfect. The vertically aligned loading fixture 71 and the holder 11 are then preferably placed into an arbor press (not shown), such that a vertical force can be applied as indicated by an arrow 74 to drive the holder 11 toward and against the loading fixture 71. A load plate 76 is preferably used in conjunction with the holder 11 to distribute the applied force from the arbor press over the entire area of the holder 11 to prevent it from becoming damaged. The combined thicknesses or heights of the loading fixture 71 and the holder 11 are chosen to be slightly larger than the lengths of the articles 12. Such a height selection prevents the articles 12 from becoming crushed between the base plate 73 and the load plate 76 during the transfer of the articles 12 to the holder 11. The alternate position of the holder 11 depicts the position of the holder after the application of the force to transfer the articles 12 to the holder 11. When the holder 11 is now lifted away from the loading fixture 71, the articles 12, now secured in the holder 11 by the force of the springs 28, are slidingly removed from the guide tracks 72 of the fixture 71.

Figure 9:
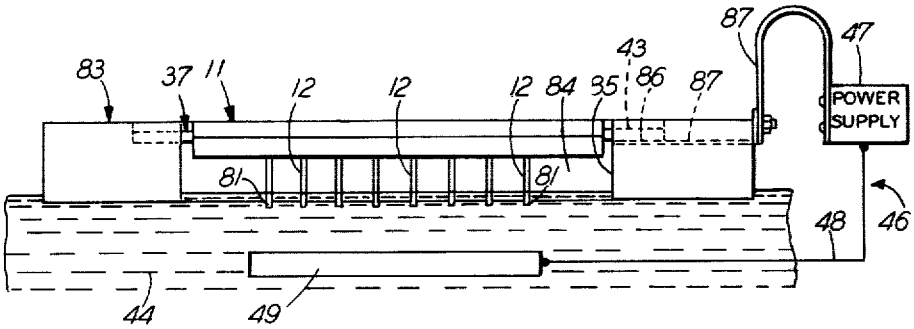
FIG. 9 shows plating an end of the articles inserted into the holder in accordance with features of this invention.

FIG. 9 shows plating a first exposed end 81 of each of the articles 12 through a partial immersion of the articles 12 into the plating bath 44. Routine apparatus is known and commercially available, whereby a holder of articles may be suspended above a plating bath such that articles to be plated, as for example the articles 12, depend a predetermined distance from a fixed datum, such as the edge of a plating tank, toward the plating bath 82. Typically, the holder is supported by a vertically adjustable frame (not shown). Such frames are well known in the art and need not be described herein in great detail. Adjustments of the frame typically attempt to compensate for differences in the liquid level of a bath such as the bath 44.

A different support of the holder, however, achieves a predetermined immersion depth of the articles 12 into the bath 44, even though a variation in the liquid level of the bath may occur. Our copending application, which is entitled "Treating Portions of Articles in a Liquid" and which is further identified as Case Maschler-Seifert 2-2, and assigned to the assignee of this application, relates to floatingly supporting articles with respect to a liquid. To supplement the description below of floatingly supporting the holder 11 with respect to the bath 44, our above-identified copending application is incorporated herein by reference.

FIG. 9 shows a floating frame 83 into which the holder 11 is placed. The frame 83 has a central, rectangular opening 84 which is of an appropriate size to accommodate the planar extent of the holder 11. The end 43 of the rods 37, however, extends outward beyond the inner walls 85 of the frame 83. The frame 83 is constructed of a light material which is buoyant on the liquid of the bath 44. A foamed plastic material of low density may be suitable for such purpose, provided pores in the outer surfaces of the frame 83 are closed and at least the outer surface of the frame is not chemically affected by the plating bath 44. A solid-walled hollow construction of a material unaffected by the bath 44 is an alternative to the foamed plastic structure. Polyethylene is a presently preferred material for such a structure.

The combined weight of the frame 83, the holder 11 and the articles 12 in the holder, together with the specific gravity of the electrolyte, are taken into account to determine the displacement of the frame in the electrolyte of the plating bath 44. The displacement of the frame 83 and its planar area determine its depth of immersion. Seats 86 are formed as recesses in the top surface of the frame 83 at a height above the bath 44 to achieve the desired depth of immersion of the ends of the articles 12 into the bath 44 when the holder 11 with a full complement of the articles 12 is placed into the frame 83.

The frame 83 has a conductor 87 coupled on at least one side to two of the four seats 86 for receiving the ends 43 of the rods 37 when the holder 11 with the articles 12 is placed into the frame 83. The conductor 87 preferably bridges the space from the frame 83 to outer structural components such as the power supply 47 through a substantially self-supporting, conductive ribbon in the shape of an inverted "U". Such an inverted "U" shape is preferred for a coupling to outer structures in that such a configuration is capable of substantially supporting its weight to avoid lifting the frame 82 or pressing it deeper into the plating bath. Plating the ends of the articles 12 is otherwise accomplished in accordance with typical, known practices for nickel plating ends of articles.

After completion of the plating operation and after such typical rinsing steps in water as may be desirable, the articles are unloaded. However, it may be particularly desirable to plate similar portions at second ends 88 (see FIG. 11) of the articles 12 for more efficient processing of such articles. In the past, using the previously described prior art magnetic holder for plating the articles 12 some articles did not become plated or received an insufficiently plated surface. Thus, prior to their assembly into an envelope of a switch, the articles 12, or stems, were inspected to ascertain if an end had in fact received a nickel coating during the plating operation and the articles were sorted and oriented to ascertain which end had such coating.

Plating the articles in accordance with the present invention is intended to substantially eliminate those of the articles 12 which lack properly plated ends after the completion of the plating operation. A cumbersome inspection of the plated articles can now be eliminated by also plating the second end 88 of each of the articles 12 in the same manner as the first end 81. The center portion of each of the articles 12 still remains unplated to permit the center portions of the articles to be securely bonded to the glass of the envelope. However, when both ends of the articles 12 are plated, either end may now be inserted into the glass envelope (not shown) within which the nickel plating of the article is a requirement to promote wettability of such plated portion by mercury. To facilitate plating both ends of the articles 12, the apertures 17 provide an open passage between the opposite surfaces 21 and 22 of the holder 11. It is now possible to reverse the projection of the ends of the articles 12 from the holder 11 without transferring them to another holder or without even removing them from the holder 11.

Figure 10:
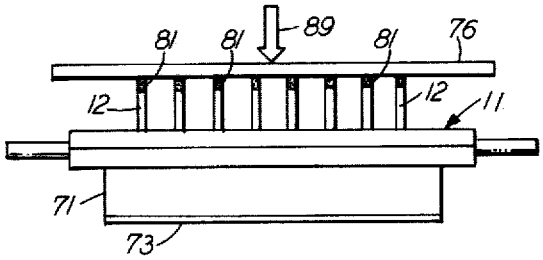
FIG. 10 shows a preferred method of repositioning the articles in the holder in preparation for plating the second end of the articles.

Referring to FIG. 10, the holder 11 from which the articles 12 with plated ends extend from one of the major surfaces thereof is now positioned above the loading fixture 71. The loading fixture 71 must not be occupied by any articles at this time. The load plate 76 is placed over the plated ends of the articles and a force sufficient to press the articles 12 into the superposed holder 11 and down into the loading fixture 71 is now applied, as indicated by an arrow 89. It is again pointed out that the combined thicknesses of the loading fixture 71 and the holder 11 are slightly greater than the lengths of the articles 12. Thus the plated ends 81 of the articles can be pressed flush with the major surface of the holder without placing a compressive stress on the articles 12. Conveniently, an arbor press may be used for such an operation. Even though the holding force by the springs 28 on each of the articles 12 in the array of the holder 11 is small, the combined resistive force by an entire array of the articles 12 has been found to be sufficiently large to warrant the use of an arbor press for loading or for exchanging a projecting position of the first ends 81 and the second ends 88 of the articles 12 as described herein.

Figure 11:
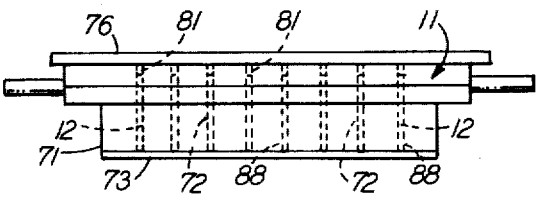
FIG. 11 shows the articles after their repositioning in the holder.

FIG. 11 depicts the holder 11 after the articles 12 have been pushed through the holder 11 by the force distributed to the articles 12 by the plate 76. After the plate 76 is removed, the holder 11 is lifted from the loading fixture 71. The unplated second ends 88 of the articles 12 now project downwardly from the holder 11 and can be subjected to plating and rinsing operations in the same manner as the first ends 81 of the articles 12. The holder 11 is placed into the floating frame 83 as described with respect to FIG. 9. Of course, any plating apparatus capable of supporting the holder 11 above the plating bath 82 to expose to the bath a portion of the articles 12 projecting downwardly from the holder may be used for both plating operations. After the second ends 88 of the articles 12 have been plated and the articles have undergone rinsing operations which typically follow such plating operation, it becomes desirable to remove the articles 12 from the holder 11.

Figure 12:
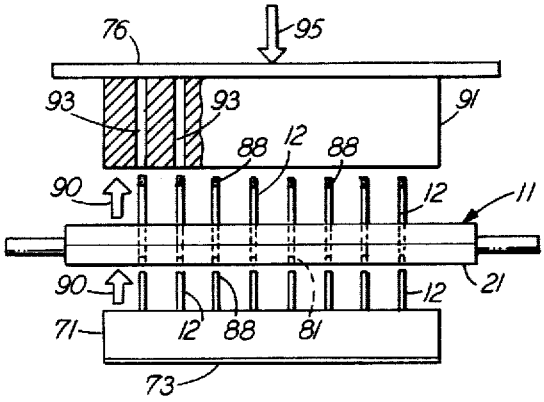
FIG. 12 shows an advantageous arrangement for loading a plurality of articles into a holder, such as the one shown in FIG. 1, and simultaneously therewith unloading a plurality of such articles previously secured by the holder.

FIG. 12 illustrates an advantageous technique for removing the plated articles 12 from the holder 11, which makes it possible to, at the same time, load an array of unplated articles 12 into the holder 11 for subsequently plating the first ends 81 of such articles 12. In preparation of such an unload-load operation, the holder 11 occupied with an array of plated articles 12 is placed into precise alignment with the loading fixture 71. In both the loading fixture 71 and in the holder 11, the protruding ends of the articles 12 extend upward, as indicated by the arrows 90, such that when the holder 11 is aligned with the loading fixture 71, the upper ends of the unplated articles 12 in the loading fixture 71 rest in the plane of the downward directed surface 21 or 22 of the holder 11 against the non-projecting ends of the articles 12 in the holder 11. An unload receptacle or spacer 91 is now placed over the projecting ends of the articles 12 in the holder 11.

The thickness of height 92 of the spacer is approximately the same but no less than the length of the articles 12. The spacer 91 is of a load-supporting vertically walled structure. In a preferred embodiment the spacer 91 is formed of a homogeneous material, such as aluminum, and has an array of vertically extending apertures 93 of the same format or arrangement as the array of apertures 17 in the holder 11. The apertures 93 are preferably larger in diameter than the apertures 17 in the holder 11. Once the articles 12 are transferred to the spacer 91, precise guiding becomes less critical than the guiding required by the load fixture 71 or by the holder 11.

The load plate 76 is placed over the spacer 91 and a vertical compressive force is applied between the load plate 76 and the base of the loading fixture 71, as indicated by the downward pointing arrow 95. The downward directed action of the force is transmitted through the spacer 91 against the holder 11. The upward directed reaction acts through the unplated articles 12 against the plated articles 12 in the holder. As a result, the plated articles 12 are ejected from the holder 11 into the apertures 93 of the spacer 91, while the unplated articles 12 take the place of the plated articles 12, except that the upper ends of the unplated articles 12 are now flush with the upward directed surface of the holder 11. The lower ends of the unplated articles project downward into the loading fixture 71 in the same manner as the articles 12 shown in FIG. 8. As with the previously described loading and end exchanging operations, the force used in the loading-unloading operation is preferably applied through a pressing action of an arbor press (not shown). However, any other apparatus for directing a vertical force toward a fixed base may be used. It may be desirable, for example, to provide a special apparatus using a hydraulic force. If such an apparatus is properly sized, it may conveniently be placed in the vicinity of where plating and loading of the articles 12 takes place.

As can be realized from the above description, various changes in the described apparatus and procedures are possible without departing from the spirit and scope of the present invention.

What is claimed is:

1. A holder for electrolytically treating ends of a plurality of elongate articles comprising:

a planar housing having a central space extending between upper and lower major surfaces thereof;

a plurality of arrayed guide apertures extending in vertical orientation to said upper and lower major surfaces through the housing;

an electrically conductive rod mounted at each of two opposite ends of said housing, said rods being positioned between, and in a plane parallel to, said upper and lower surfaces, said rods extending laterally from said housing as lateral supports for the housing; and a plurality of tension springs mounted between said rods and extending through said central space between said upper and lower major surfaces of said housing, said springs being restrained from vertical movement by inner portions of said housing, said springs extending into laterally interfering relationship with the vertical projections of said guide apertures, whereby the elongate articles inserted into said guide apertures and into resiliently yielding contact with said springs are held by said springs against wall portions of said guide apertures, said springs electrically contacting said articles to the laterally extending rods, such that the housing may be supported by said rods in either one of two orientations on external electrolytic circuit supports and either ends of the articles protruding from said housing is capable of being positioned downward to depend into an electrolytic treating bath.

2. A holder for electrolytically treating ends of a plurality of elongate articles according to claim 1, wherein:

the housing comprises an upper and a lower plate, each plate having an outwardly facing planar surface, such planar surfaces being mutually parallel, the plates further having outer wall portions for spacing inner surfaces from each other and forming said central space of a height for receiving and vertically restraining said springs.

3. A method of electrolytically treating at least one of two ends of a plurality of elongate articles comprising:

inserting a plurality of the articles into guide apertures oriented perpendicularly to two outwardly opposite, parallel surfaces of a holder, and into contact with vertically restrained tension springs located within said holder, such that first ends of such articles to be treated extend from the guide apertures of the holder and the second ends of the articles become substantially flush with one of the surface of the holder;

mounting the holder by laterally extending rods to electrical contacts above an electrolytic treating fluid, said rods coupling said articles through said springs into an electrolytic treating circuit, such that the first ends depend downward from said holder into such electrolytic treating fluid;

electrolytically treating the depending first ends of the articles; and after treating said articles, inserting a second plurality of articles collinearly with said plurality of electrolytically treated articles into said guide aperture of said holder and urging said treated articles from said holder.

4. A method according to claim 3, wherein after electrolytically treating the depending first ends of the articles, such depending first ends are urged into the holder into a substantially flush position with a respective one of the surfaces of the holder, and the holder is mounted invertedly on said electrical contacts to expose such second ends of such articles.

* * * * *